United States Patent [19]

Battel

[11] Patent Number: 5,048,632

[45] Date of Patent: Sep. 17, 1991

[54] SELF-PROPELLED DEVICE

[76] Inventor: Gerard R. Battel, 3, Chemin du Bois Payen, Pontoise 95300, France

[21] Appl. No.: 423,358

[22] Filed: Oct. 18, 1989

[30] Foreign Application Priority Data

Oct. 26, 1988 [FR] France ..... 88 13955

[51] Int. Cl.[5] ..... B60K 17/04

[52] U.S. Cl. ..... 180/181; 180/9.1; 180/79.4; 280/11.115; 280/11.27; 280/87.042

[58] Field of Search ..... 180/180, 181, 79, 79.3, 180/9, 9.1, 79.4; 280/841, 11.115, 11.27, 11.28, 87.042

[56] References Cited

U.S. PATENT DOCUMENTS

| | | | |
|---|---|---|---|
| 1,672,700 | 6/1928 | Vass | 180/181 X |
| 1,694,671 | 12/1928 | Rodelli | 180/181 |
| 2,625,229 | 1/1953 | Van Voorhees | 180/181 |
| 2,857,008 | 10/1958 | Pirrello | 180/181 |
| 3,876,032 | 4/1975 | Ferino | 180/181 |
| 4,069,881 | 1/1978 | Shiber | 180/181 |
| 4,094,372 | 6/1978 | Notter | 180/181 |
| 4,508,187 | 4/1985 | Wenzel | 180/181 |
| 4,546,841 | 10/1985 | Sipiano | 180/181 |
| 4,691,931 | 9/1987 | Vincent | 280/11.115 |

FOREIGN PATENT DOCUMENTS

| | | |
|---|---|---|
| 835558 | 4/1952 | Fed. Rep. of Germany . |
| 2241855 | 3/1974 | Fed. Rep. of Germany . |
| 2392688 | 12/1978 | France . |
| 2604915 | 4/1988 | France . |
| 513031 | 2/1937 | United Kingdom . |

*Primary Examiner*—Charles A. Marmor
*Assistant Examiner*—Michael Mar
*Attorney, Agent, or Firm*—McAulay Fisher Nissen Goldberg & Kiel

[57] ABSTRACT

A self-propelled roller skate device comprising two units disposed in parallel, each unit being supported on front and rear pairs of wheels, each of the units includes at least one propulsion system, a steering system mounted on a support and holding structure, a power generation and storage system mounted independently of each of the units, and a remote control operatively coupled with and acting on each of the units and the power generation and storage system. The steering system includes a deformable parallelogram arrangement which converts pivoting movement of a sole-piece about a longitudinal axis into movement for turning the front wheels of the unit.

10 Claims, 9 Drawing Sheets

SELF-PROPELLED DEVICE

BACKGROUND OF THE INVENTION

The present invention relates to a self-propelled device, for example roller skates, skates usable on skis for going up a slope easily, etc..

Self-propelled skates are known, but these devices are not remote controlled, are not independent for long periods of time and are not in general equipped with a suspension, a braking system and a steering system. Furthermore, the existing devices do not have a variator for varying the speed of the wheels or of the driven caterpillar tracks.

The present invention makes is possible to overcome these drawbacks. Thus, the source of power for driving the device is a thermal engine which is not mounted on the device itself and is remote controlled by the same means and devices as the propulsion and braking systems mounted on the device for example.

SUMMARY OF THE INVENTION

Thus, in accordance with the invention, the self-propelled device comprises at least one unit having a propulsion system, characterized in that at least one unit of said device comprises, optionally, at least one of the following systems braking system, suspension system, steering system, these systems (or system) being remote controlled, remote control means being further provided which also control a power generation and storage system. It comprises at least two units disposed in parallel, each of these units being equipped with at least one propulsion system mounted on a support and holding structure, said remote control means acting simultaneously on the systems mounted on said units, as well as on said power generation and storage system which is mounted independently of said units.

The remote control means are connected to said power generation and storage system mounted independently of said units, on the one hand, and to said systems mounted on said units, on the other. These means being essentially an electronic, electric, hydraulic or equivalent regulation device; overload and overpressure release devices and an order control and transmitting means actuated, manually.

The structure comprises a part for supporting the load to be transported and a part for holding at least one of the propulsion, braking, suspension and steering systems in position.

The only power generation and storage system mounted independently of said units comprises, in series, a thermal engine, an electric, pneumatic, hydraulic or equivalent power generator, a regulation device and a power storage reservoir.

The control means are connected to safety devices for actuating or overriding simultaneously the braking systems mounted optionally on each of said units, said control giving priority to braking instead of acceleration.

In a first embodiment, the device of the invention for example roller skates, comprises on each of said units four wheels mounted in twos on a front frame and a rear frame of said structure, respectively, said rear wheels forming part of the propulsion system (i) being driving at speeds selected by means of a speed variator actuated by a motor, via a bevel gear device (a box), a braking system (ii) acting on at least one of said driving wheels, being provided as well as a steering system (iii) and a suspension system (iv) comprising suspension devices for the front wheels and suspension devices for the rear wheels.

The front frame is connected to the rear frame via said motor and said speed variator. The speed variator is a gear-box with pinions controlled by jacks from said control system, connected to the rear wheels through the bevel gear box and a drive through a universal or Cardan joint or a flexible coupling transmitting the rotational movement in a single direction.

The braking system comprises disks mounted on at least the drive wheels and brake linings, the relative movement between said disks and said linings for applying these latter by mechanical, hydraulic, electromagnetic or equivalent means being remote controlled from said control system.

The safety devices comprise a contactor which overrides the braking so as to control the bearing position on the ground.

For the suspension of the front steering wheels, two dampers (one per wheel) are articulated both to the ends of the triangles of the front frame and by shafts to the upper wall (between the front wall and the rear wall) of the front frame, a stabilizing bar connected laterally to two links being supported by the front wall of the front frame.

The suspension of the rear wheels is provided by dampers connected both to parallelograms and to the plate forming part of the rear frame, a stabilizing bar being carried by two links on said parallelograms so as to permit articulation thereof, means being further provided for shortening or lengthening the lower part of said parallelograms.

The steering system comprises a sole-piece which pivots by the action of the load carried about shafts disposed one behind the other parallel to the longitudinal axis of a unit of the device against a resilient return means, said sole-piece being connected to the kinematic chain permitting the angular movement (with respect to the longitudinal axis of the device) of the front wheels.

The sole-piece comprises a lower (steering) plate and an upper plate on which the load (for example a foot) bears, means with a resilient return means being provided for locking said load.

The kinematic chain comprises essentially a deformable parallelogram formed by two links articulated both to a sole-piece which is rigidly connected to said plate so that said links effect substantially vertical movements during pivoting of said plate about axes substantially parallel to the longitudinal axis of the unit and to a steering "T" pivoting about a shaft mounted on the rear wall of the front frame and links and ball joints transforming the vertical movement of said links due to pivoting of said plate into a horizontal angular movement of the front wheels of the unit, means being provided for (i) regulating the steering sensitivity and (ii) the size of the steering angle.

The means are (i) holes formed in said links disposed vertically and in the steering "T" and (ii) members for regulating the length of the horizontally disposed links.

A protective bodywork is mounted fixedly on the structure supporting and holding the unit in position.

In another embodiment, the device of the invention comprises a propulsion system mounted on at least one unit, which unit is fixed to a ski, at least partially, above an opening formed therein.

Each unit comprises a drive track advancing in only one direction, said track comprising essentially a flexible band, a ball race, a tensioning roller and a drive device in the form of a pulley or pinion which may be lowered through the orifice formed in the ski until said flexible band comes into contact with the ground, means being provided for raising and lowering the band.

The means are essentially formed by a guide articulated both to the drive shaft of the track properly speaking and to the motor shaft by means of a friction member, this motor shaft being driven by the motor via a speed variation box and a bevel gear box, the rotary lowering and raising movement being controlled by a lever fixed to a rod articulated to a link and right-angle levers acting on studs integral with the track cover.

Resilient means are fixed both to the track covers and to the skis; these means facilitate lowering of said track and make it possible to obtain very good adherence between the tracks properly speaking and the ground; devices for locking the track being further provided.

A cover protects the track and its drive.

In yet another embodiment, each unit has a double track driven in a single direction by notched wheels, these notched wheels being mounted on a rigid front assembly consisting essentially of parallelograms, rigid links and a rigid rear assembly consisting essentially of a lower parallelogram with means for adjusting its length, an upper parallelogram and two supports, means for driving the rear notched wheels being mounted between said rigid front and rear assemblies.

BRIEF DESCRIPTION OF THE DRAWINGS

To better illustrate the objects of the invention, several embodiments will now be described by way of purely illustrative and non limitative examples, with reference to the accompanying drawings in which.

DESCRIPTION OF THE PREFERRED EMBODIMENTS

Figure 1:
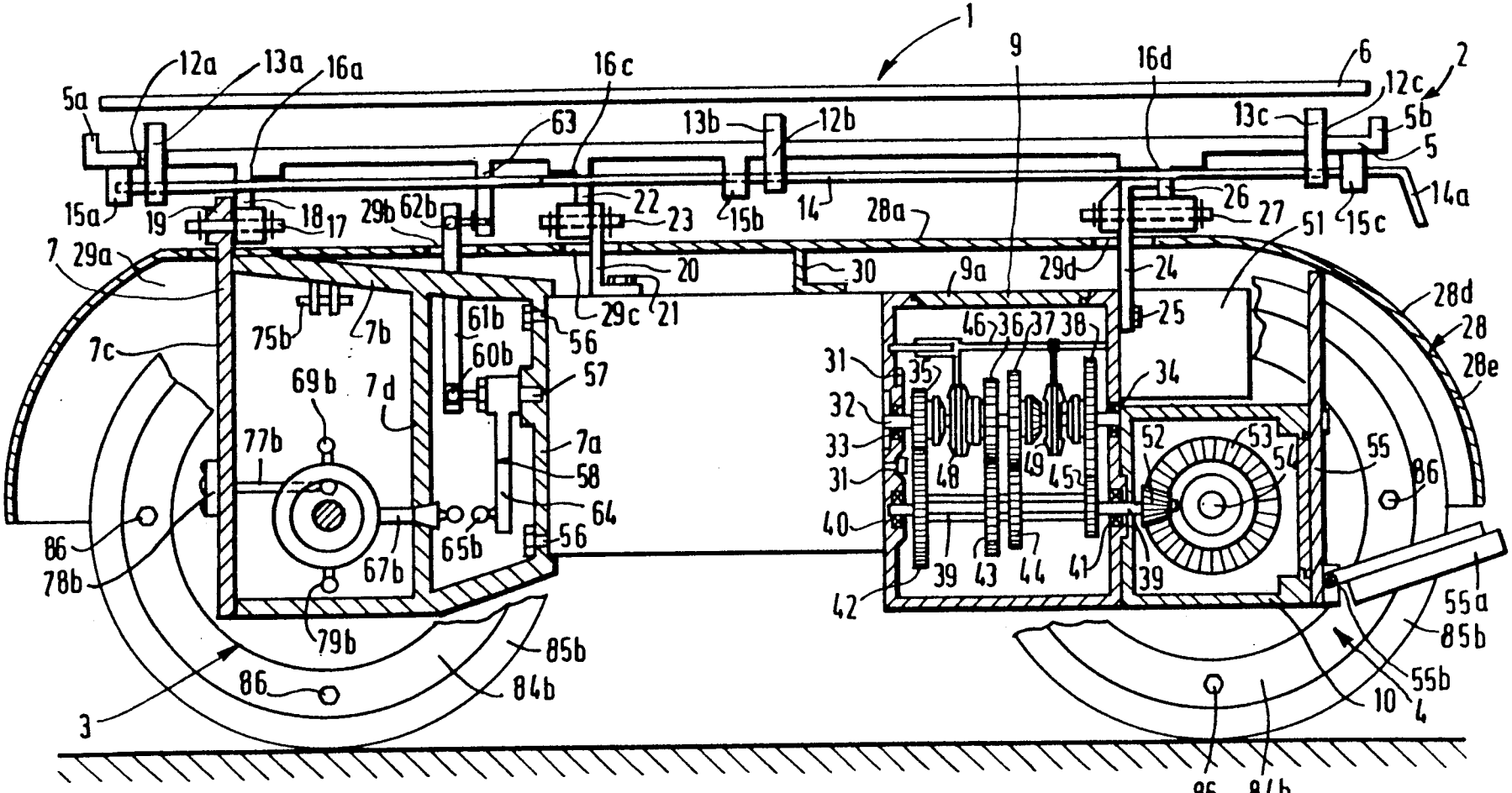
FIGS. 1 and 2 are longitudinal, respectively vertical and horizontal, sectional views of a roller skate in accordance with the invention.

In FIG. 1 there is shown, in vertical longitudinal section, a unit of said device which may be a roller skate 1 in accordance with the invention comprising a sole-piece 2 for supporting a shoe, this sole-piece being provided with four wheels, namely two front wheels 3 and two rear wheels 4.

The sole-piece 2 is formed of a lower wheel plate 5 and an upper plate 6 on which the foot bears and whose free surface is advantageously non slip.

Furthermore, the two front wheels 3 are connected by a front frame 7, itself situated in front of a motor 8, which transmits the movement to a gear-box 9, situated at the rear of motor 8 and cooperating with a bevel gear box 10 of the rear frame 11, connecting the two rear wheels 4 together.

The steering plate 5 is bent once at right angles upwards along its two front and rear edges respectively **5*a* and 5*b*, and twice at right angles upwards, then inwards at 5*c*** on its inner longitudinal edge considering the position of the shoe of the user.

In the steering plate 5 are formed three openings, at the front, centrally and at the rear respectively **12*a*, 12*b* and 12*c*. Through each of these openings 12*a* to 12*c* passes a latch respectively 13*a*, 13*b* and 13*c*, perpendicularly to plate 5. These latches 13*a* to 13*c* comprise, in their part situated under plate 5, orifices for passing an elongate plate 14, parallel to said plate 5 and disposed along the longitudinal axis of the latter. Plate 14, bent at its rear part at 14*a* is held in position by three guide elements, at the front, centrally and at the rear, respectively 15*a*, 15*b* and 15*c*, which are formed by downward directed projections, carried by the lower face of plate 5. The lower plate or shaft 14 passes through the central and rear guide elements, respectively 14*b* and 14*c*, and it penetrates by its front end into a cavity in the guide element 15*a***.

The steering plate 5 is held in position at the front on the front frame 7 by a pinned shaft 17. For this, plate 5 has a downward projection 18 and the front frame 7 has an upward projection 19, the two projections 18 and 19 bearing one against the other and being connected together by the shaft 17 parallel to the longitudinal axis of the roller skate.

In the central part, plate 5 is similarly connected to the casing of the motor unit 8. For this, on said casing is disposed a bracket 20 fixed thereto by a bolt 21 and cooperating with a downward directed projection 22, carried by plate 5, a shaft 23 connecting the bracket 20 and projection 22 together. The aperture **16*c* allows the projection 22 to pass through plate 14**.

At the rear, plate 5 is held in position on the gearbox 9. For this, a support plate 24 is fixed by bolts 25 to the rear of said gear-box and plate 5 comprises a downward projection 26 and is connected to the support plate 24 by a shaft 27 locked by a pin.

A spring **27*a* (FIG. 3) forces plate 5** to come back to its central position.

A protective bodywork 28 is provided which comprises a central plate **28*a*, parallel to plate 14 and disposed therebelow. Said plate 28*a* is bordered by two slanting longitudinal flanges 28*b*, opening outwardly, which are extended externally by extensions 28*c* overhanging the wheels 3 and 4 and bent downwards through rounded zones 28*d* so as to form lateral protections 28*e* reaching almost the level of the hubs of wheels 3 and 4**.

Plate **28*a* comprises, from the front to the rear, apertures respectively 29*a*, 29*b*, 29*c* and 29*d*. Apertures 29*a*, 29*c* and 29*d* permit the passage of three elements for connecting the steering plate 5, respectively to the front frame 7, to the casing of motor 8 and to the gear-box 9, as was described above. Plate 28*a* is further fixed to the casing of motor 8 by a central bracket 30** bolted to said casing.

The motor 8 transmits the movement to the gear-box 9 which comprises a removable wall 28 giving access thereto as required. The gear-box 9 is fixed to the casing of motor 8 by bolts 31. The drive shaft is extended by a primary shaft 32 supported, at each end of box 9, by front and rear bearings respectively 33 and 34. On the primary shaft 32 four pinions 35 to 38, from the front to the rear, rotate freely.

A secondary shaft 39 is also disposed in the gear-box 9 parallel to the primary shaft and therebelow. It is held in position by bearings 40, 41, at each of its ends, and it receives a set of four pinions, respectively 42, 43, 44 and 45, cooperating respectively with the pinions 35, 36, 37 and 38.

Two control rods respectively 46 and 47 (FIG. 2) actuate synchro rings, respectively 48 and 49, each having three positions and disposed, for the first one, between pinions 35 and 36 and, for the second one, between pinions 37 and 38. The synchro rings 48 and 49 control jacks respectively 50 and 51 (FIG. 3), also having three positions corresponding to those of the synchro rings.

The gear change takes place as follows : with ring 48 in a front position in the travel direction, the first gear is engaged and held by jack 50, controlled by rod 46. In its intermediate position, jack 50 maintains the neutral position. When jack 50 is in a second position, the second gear is engaged, ring 48 having slid over the splined shaft 32 and having engaged pinion 36 with said shaft 32. When jack 50 is no longer driven in first gear, namely when it has come back to the central point or neutral point, jack 51 is no longer self locked and permits engagement of the third gear through the control rod 47, causing the synchro 49 to slide over the splined shaft 32 towards pinion 37, on which it is locked. The fourth gear is controlled by jack 51, causing the control rod 47 to cause the synchro ring 49 to slide over said shaft 32 in the direction of pinion 38, locking it firmly to shafts 32.

When the skater desires to change to a higher or lower gear, he will operate this gear change by the control fixed to his right or left hand by pressing a push button.

For example, if jack 50 is positioned in the second gear and if the skater desires to change to third gear, the first phase of execution will return to the neutral point (central point). Jack 50 is controlled by the return contactor to the neutral position; only jack 51 will be able to cause the synchro ring 49 to advance towards pinion 37 for engaging the third gear. It should not be forgotten that the skater has a skate on each foot and only one control in his hand and when there is a gear change, it will take place at the same time on the right skate and on the left skate.

The bevel gear box 10 is held in position on the gear-box 9 by bolts not shown, spaced in a circle about shaft 39 and a centering shoulder (also not shown) holds it in position.

The secondary shaft 39 penetrates into the bevel gear box 10 and at its end it has a tapered pinion 52 cooperating with a large gear ring 53 keyed to a shaft 54. The direction of rotation of shaft 54 may be reversed by rotating box 10 by half a revolution with respect to box 9 and for this it is sufficient to remove the fixing bolts to cause the box 10 to pivot through half a revolution, then to reposition the bolts.

At the rear of the gear-box 10 is fixed a vertical plate 55, by means of bolts not shown, whose role is described further on.

At the front, the frame 7 is held in position on the casing of motor 8 by bolts 56, spaced evenly apart about a circle. The wall **7*a* of frame 7 which is adjoining the casing of motor 8 carries the pivot shaft 57 of a steering T 58. The top part 59 of the steering T 58 has, in a shoulder at each of its ends, a ball joint 60*a*, 60*b* in alignment with shaft 57, each of the ball joints 60*a*, 60*b* controlling a rigid link 61*a*, 61*b* passing through the upper wall 7*b* of frame 7 and plate 28*a* through said opening 29*b*. Each link 61*a*, 61*b* has, at its end opposite the ball joints respectively 60*a*, 60*b*, a housing receiving another ball joint 62*a*, 62*b* whose shafts are carried by the steering sole-piece 63 and are parallel to the axes of the ball joints 60*a*, 60*b*. These latter as well as ball joints 62*a* and 62*b*** form a deformable parallelogram.

Several holes are formed in the steering T 58 and in the steering sole-piece 63 so as to make the steering of skate 1 more or less sensitive, depending on whether links **61*a*, 61*b*** move away from or towards the center.

The steering sole-piece 63 is held in position on the frame by a pinned shaft **63*a***.

At the lower part 64 of the steering T 58, and on each side thereof, are fixed two ball joints respectively **65*a*, 65*b* each cooperating with a link respectively 66*a*, 66*b* having an adjustable length. Each link 66*a*, 66*b* receives, at the other end, a ball joint rod, respectively 67*a*, 67*b* which is fixed to the hub respectively 68*a*, 68*b* of the front wheels 3**.

Figure 2:
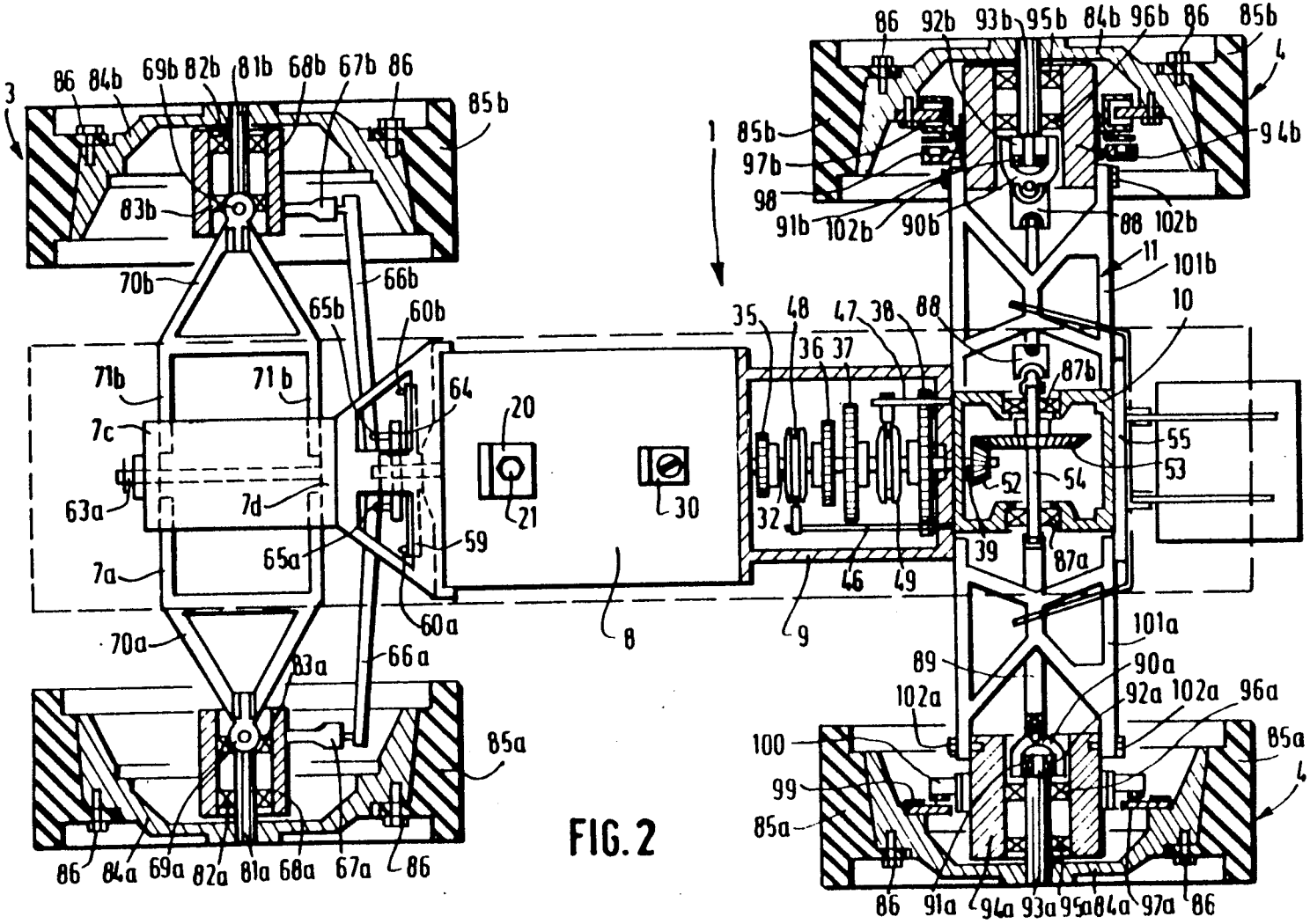

The hubs respectively **68*a*, 68*b* carry so-called top ball joints, respectively 69*a*, 69*b* which connect together the tips of triangular portions 70*a*, 70*b* of elements called upper parallelograms 71*a*, 71*b* ending in two parallel branches extending the triangle and situated in the axis thereof passing through its apex connected to ball joint 69*a*, 69*b*, these branches being fixed respectively to the front wall 7*c* of the front frame 7 and to an intermediate dividing wall 7*d*, parallel thereto (FIGS. 1 and 2**).

Figure 4:
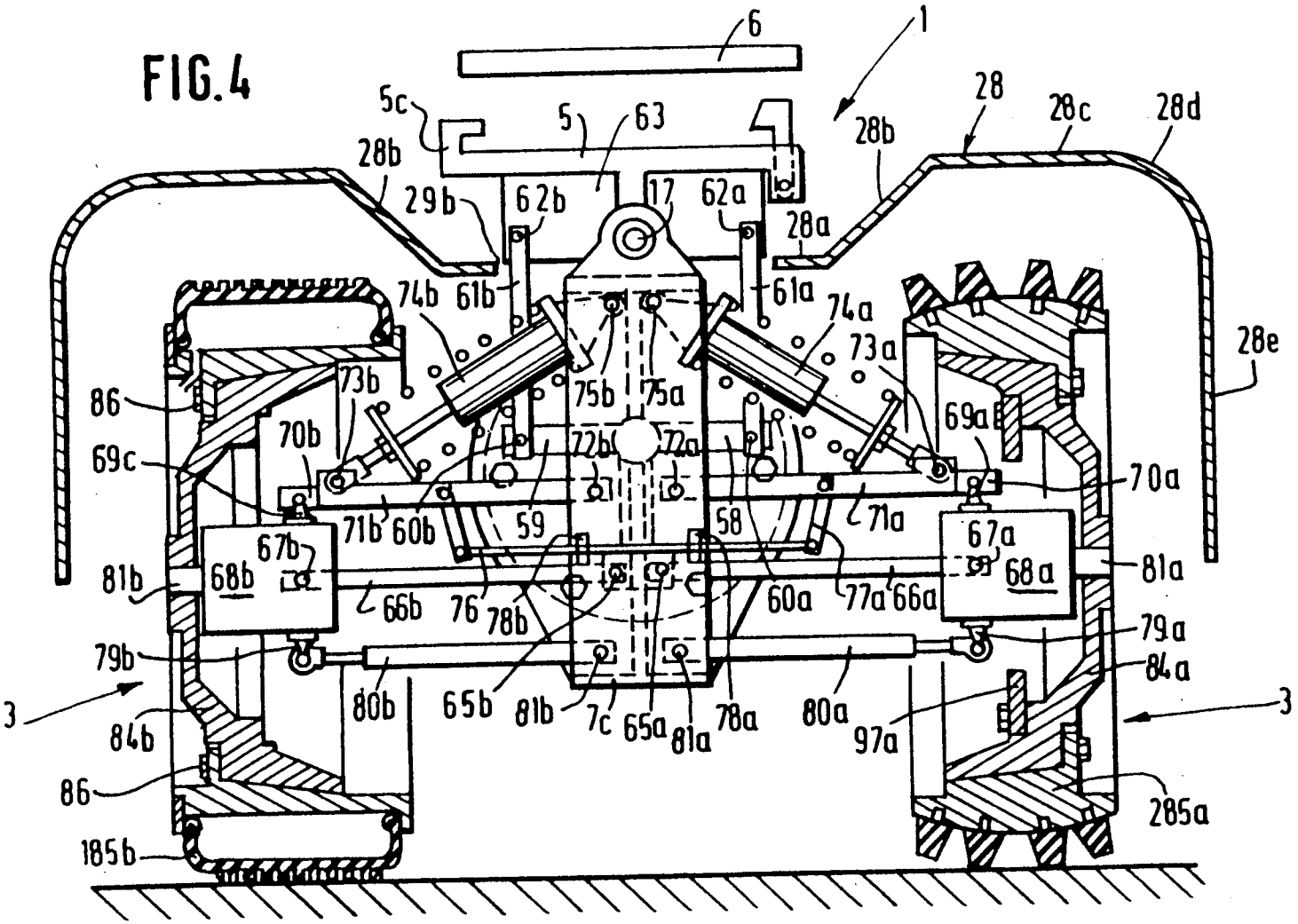

At the ends of the triangles **70*a*, 70*b* are fixed, by means of shafts 73*a*, 73*b*, suspension dampers respectively 74*a*, 74*b* held in position on wall 7*b* between walls 7*a* and 7*c* by shafts respectively 75*a*, 75*b* (FIGS. 1 and 4**).

A front stabilizing bar 76 (FIG. 4), connected laterally to two links **77*a*, 77*b* is supported in two bearings respectively 78*a*, 78*b*, carried by the front wall 7*c* of the frame 7. Each of the two links 77*a*, 77*b* is fixed to an element 71*a*, 71*b* as can be seen in FIG. 4**.

On the low part of the hubs respectively **68*a*, 68*b* are disposed ball joints 79*a*, 79*b* which are threaded for adjusting the lower parallelogram links 80*a*, 80*b* which are fixed at their ends to frame 7**.

Hubs **68*a*, 68*b* receive the shafts 81*a*, 81*b* of wheels 3, which are supported by bearings 82*a*, 83*a*; 82*b*, 83*b*. It goes without saying that sealing is provided by seals, which have not been shown. The shafts 81*a*, 81*b* carry the rims respectively 84*a*, 84*b*, by a hard and crimped mounting, not shown in the drawings. On rims 84*a*, 84*b* are fixed smooth tread wheels 85*a*, 85*b*, as shown in FIGS. 1 and 2 or else inflatable pneumatic wheels, such as shown at 185*b* in FIG. 4 (left hand part), or wheels with flexible and rigid studs, such a shown at 285*b* in FIG. 4 (right hand part). All these wheels are held in position by bolts 86 spaced apart about the periphery for screwing into the rims 84*a*, 84*b***.

The rims, wheels and bolts for fixing the wheels are identical for the front wheels 3 and the rear wheels 4. These elements have therefore been designated in the drawing by the same references.

The transmission shaft 54 of the bevel gear box 10 is held in position by bearings 87*a*, 87*b*. On one side of the output of shaft 54 is disposed a double homocinetic sliding Cardan 88 whose articulation, on each side, is aligned with the articulation of the suspension. On the other side of the output of shaft 54 is disposed a flexible coupling transmission 89, since there is no rearward travel. The spring type flexible coupling transmits the movement in one direction only, in accordance with the invention.

Skates 1 may be equipped either with Cardans or flexible couplings, such as described above. The output of these Cardans or flexible couplings is fixed to fork joints respectively 90*a*, 90*b* inside which are located ball bearings 91*a*, 91*b*, and free wheels 92*a*, 92*b*, mounted side by side on shafts 93*a* and 93*b* passing inside the hubs 94*a*, 94*b* which are held in position by bearings 95*a* and 95*b* and 96*a* and 96*b*.

The shafts 93*a*, 93*b* support rims 84*a*, 84*b* as well as wheels 85*a*, 85*b* and their bolts 86.

Figure 6:
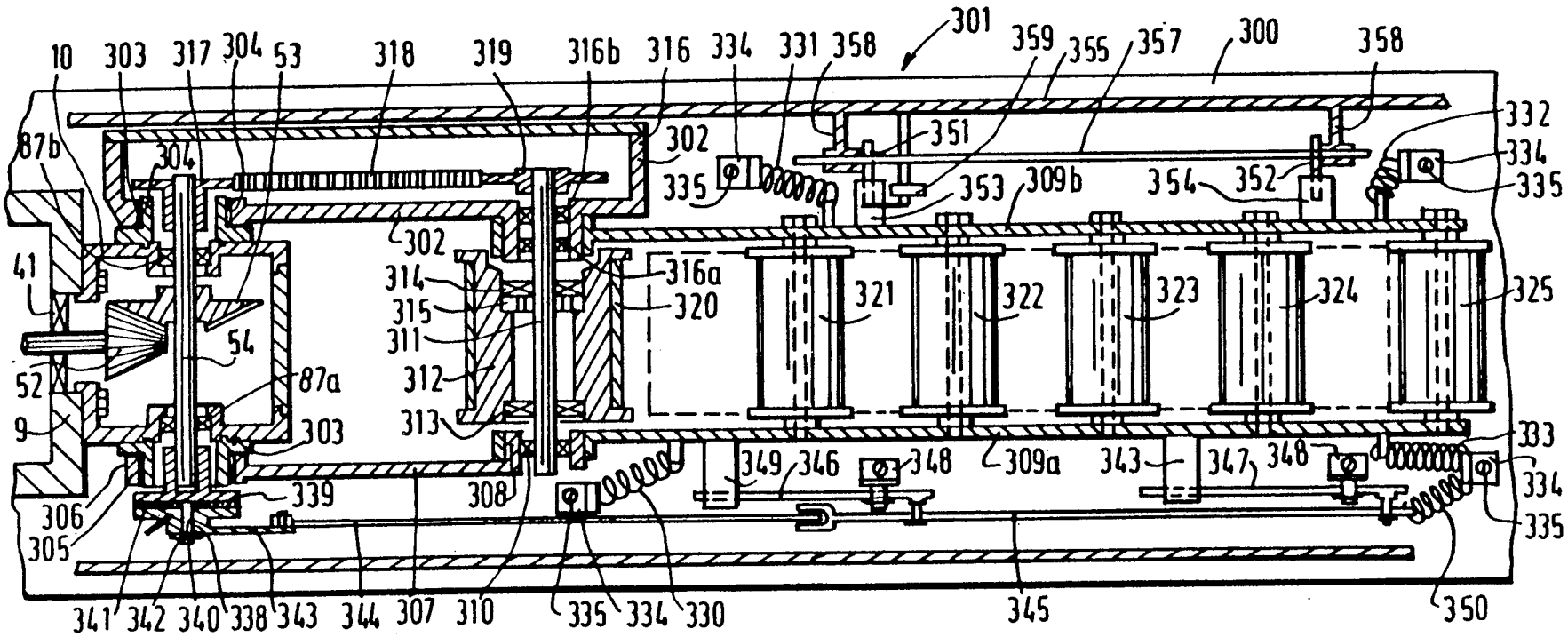
FIG. 6 shows, in a longitudinal horizontal section, the mechanism of the transmission part of a ski, equipped in accordance with the present invention.

The lower faces of rims 84*a*, 84*b* of the front and rear wheels may receive braking disks, such as disks 97*a*, 97*b* shown for the rear wheels 4 in FIG. 6. The braking may be of clamping type by "ferodo" brake linings 98, as shown in FIG. 2 for the right hand rear wheel, on each side of disk 97*b*, or else by bearing on a single side, as shown at 99, 100 in FIG. 2, for the left hand rear wheel.

The rear suspension of skate 1 is formed by the upper parallelograms 101*a*, 101*b* articulated, on one side, to the gear-box 9 by bolts 102*a*, 102*b* (FIG. 3) and on the other to the hubs 84*a*, 84*b*, by bolts 103*a*, 103*b*.

The suspension is formed by jacks 104*a*, 104*b* and damping springs 105*a*, 105*b*, the whole being connected on the one hand to parallelograms 101*a*, 101*b* at the points respectively 106*a*, 106*b* and, on the opposite side, to plate 55 by bolts 107*a*, 107*b*.

A stabilizing bar 108, held in position by two fork joints 109*a*, 109*b* is carried by two links respectively 110*a*, 110*b* on the parallelograms 101*a*, 101*b* for articulation thereof.

The lower parallelograms (see FIG. 3) designated by the references 111*a*, 111*b* are different, for they may be extended or shortened by the arrangement of threaded bars with right hand thread and left hand thread, respectively 112*a*, 112*b*. The lower parallelograms 111*a*, 111*b* are fixed to plate 55 by bolts respectively 113*a*, 113*b* and to the hubs respectively 94*a*, 94*b* by bolts 114*a*, 114*b*.

A contactor 115 (FIG. 3) controls the position of bearing on the ground so as to override braking with the foot raised.

Figure 3:
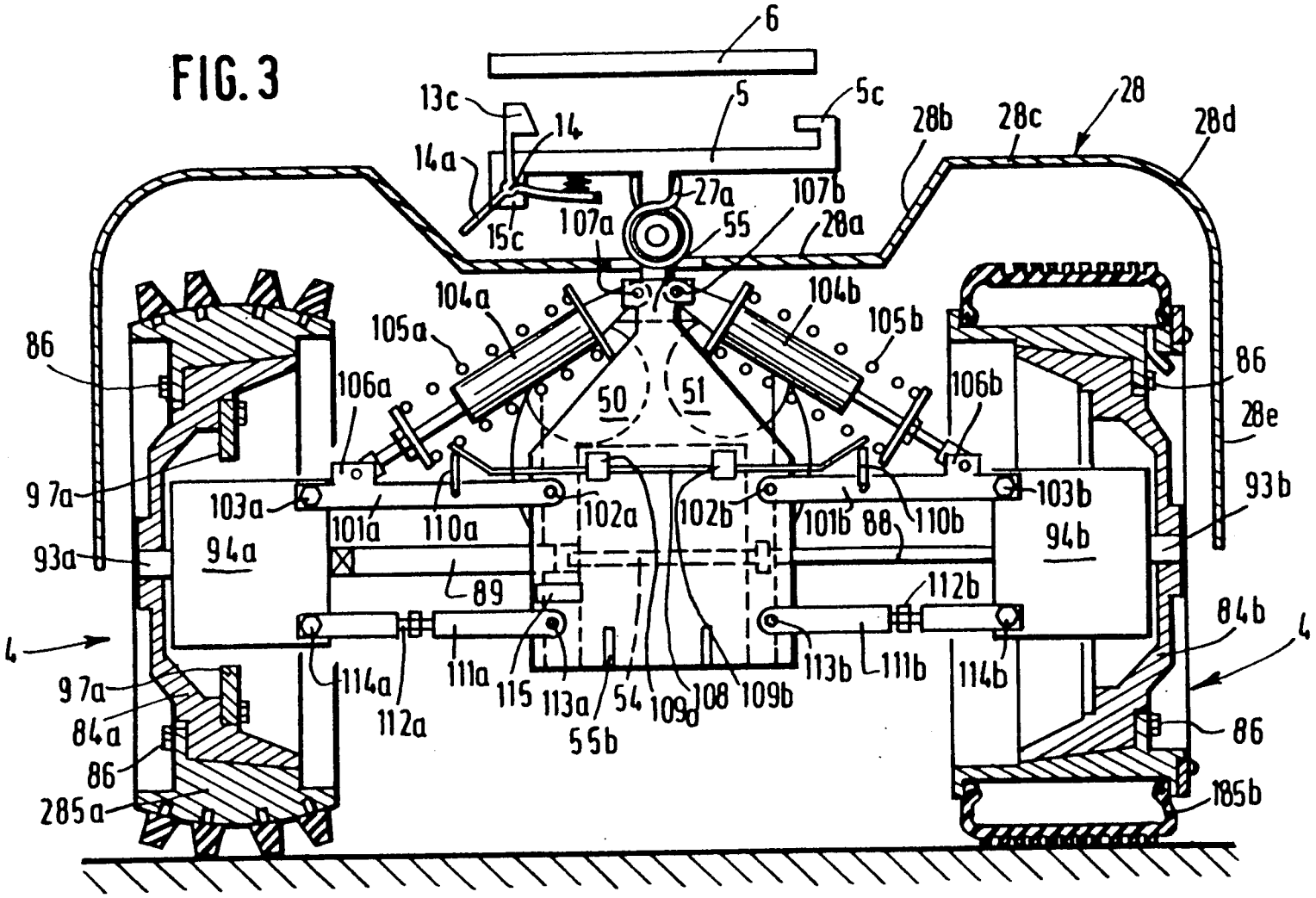
FIGS. 3 and 4 are cross sectional views, respectively at the rear part and at the front part of the roller skates of FIGS. 1 and 2.

Furthermore, the rear plate 55 has a safety brake solepiece 55*a* fixed at 55*b* (FIGS. 1 and 3).

Figure 5:
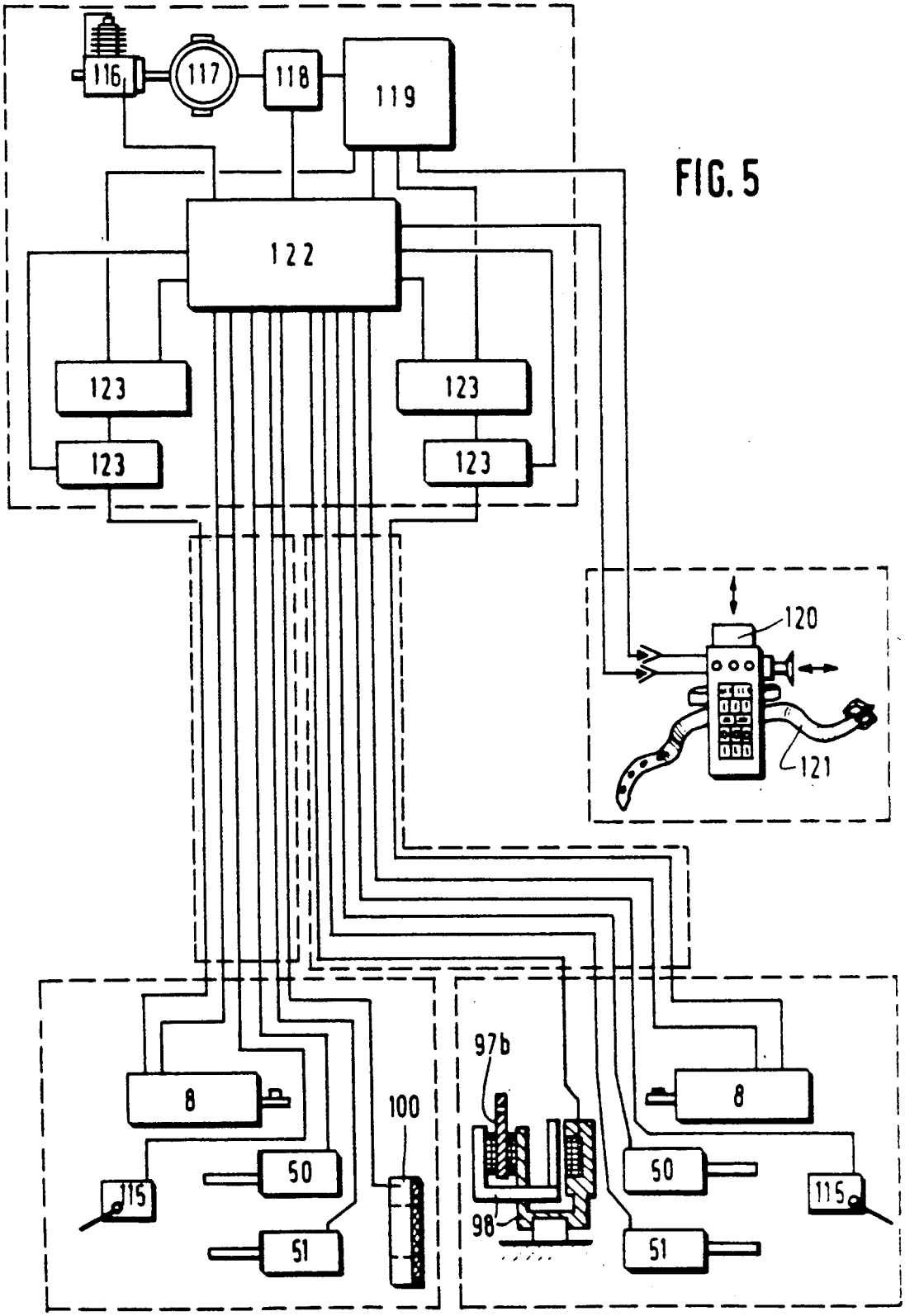
FIG. 5 shows the diagram of mounting the control for the roller skate of FIGS. 1 to 4.

In FIG. 5 is shown a thermal engine 116 which actuates a power generator 117, regulated at 118, for storing power in a reservoir 119 part of the energy of which reaches the manual control 120. The latter is held in the palm of the hand and fastened to the wrist by a strap 121. A control may be provided for the right hand or the left hand; the one shown corresponds to the right hand.

The throttle control is proportional to the amount the control is pressed in by the thumb. Braking takes place on all the wheels of the skate 1 by pressing the control with the four fingers. A set of indicator lights and check means (pressures, flowrates, speeds) makes it possible to control the orders given.

An electronic or hydraulic regulation 122 controls the motors. The overloads and over pressures are locked at 123. Regulation 122 also controls the gear changing and locks at the opportune moment so as not to have two gears at the same time.

The control gives priority to braking instead of acceleration and if the skater accelerates too rapidly, the engine passes to the safety position. It will then be necessary to start from zero with the acceleration control so as to resume normal operation.

Figure 7:
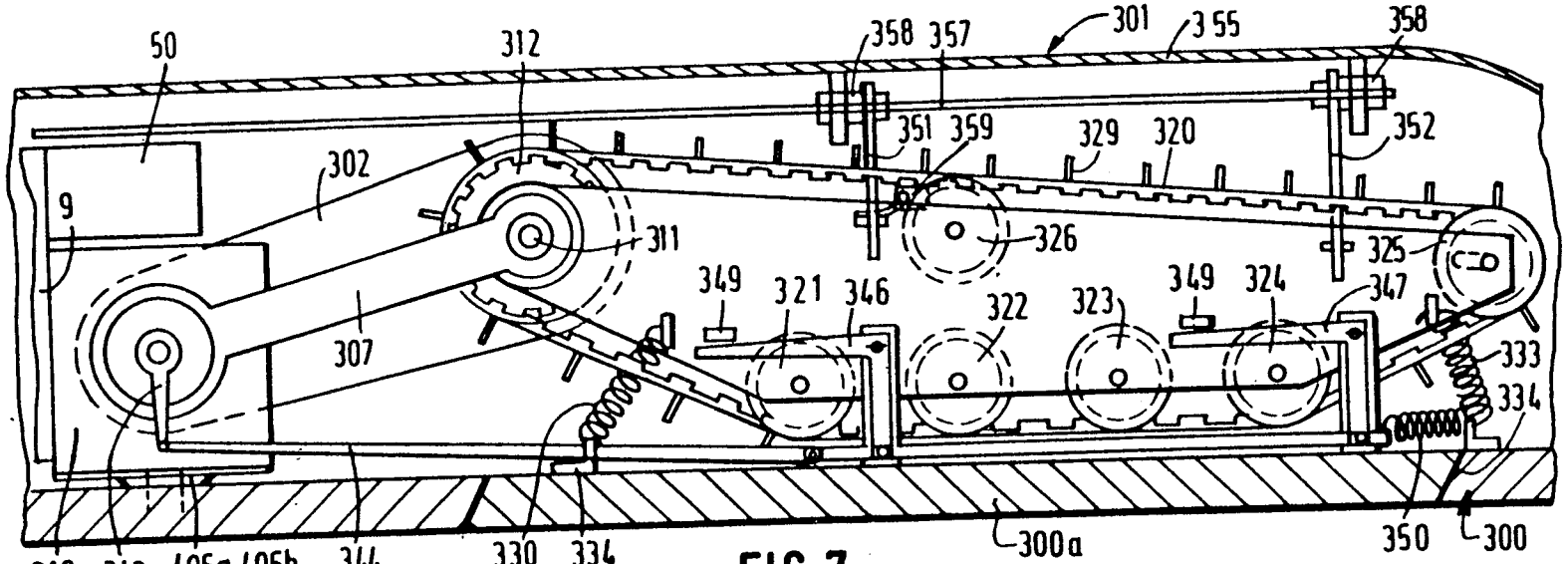
FIG. 7 shows a cross sectional view corresponding to FIG. 6, showing the track of the ski.
Figure 8:
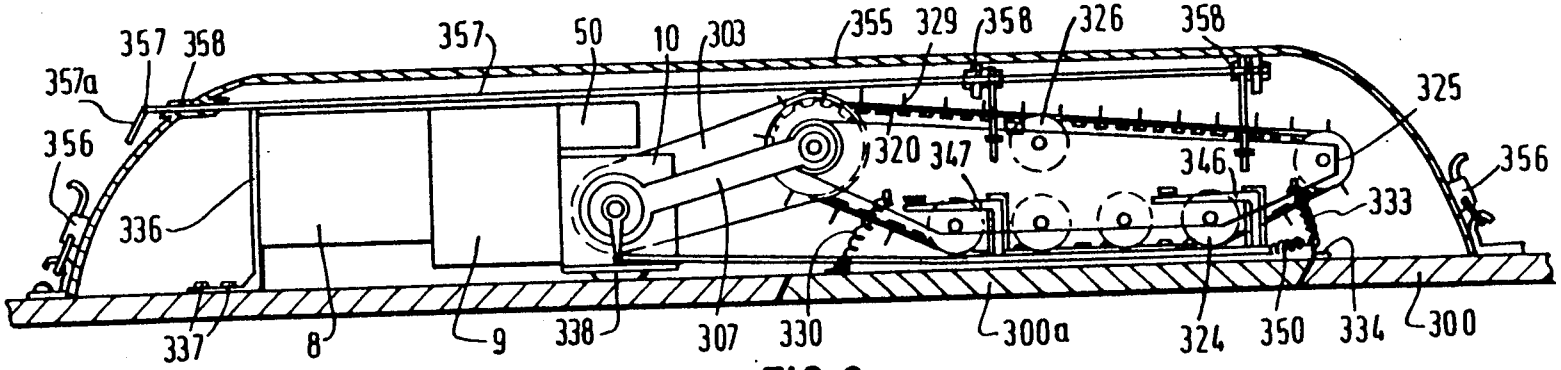
FIG. 8 shows, in cross section, the complete track mounted on the ski of FIGS. 6 and 7.

Referring now to FIGS. 6 to 8, a ski 300 in accordance with the present invention is shown. The elements of ski 301 which are identical on ski 300 have been designated by the same references as those used for describing skate 1. These are the motor 8, the gear-box 9 and the bevel gear box 10 with its elements 41; 52–54; 87*a* and 87*b*, as well as 50.

The caterpillar track is an assembly articulated on one side formed of the transmission casing 302 with its cover and screws. The transmission casing 302 is held in position on the bevel gear box by a tubular support 303, itself held in position by screws not shown. The support 303 provides articulation of casing 302 through a wear ring 304.

On the other side of the bevel gear box 18 is disposed an identical tubular support 303 held in position by screws not shown providing articulation and rigidity, covered by a wear ring 305 cooperating with the end forming bearing 306 of a guide piece 307.

At the opposite side, guide 307 comprises a ring 308 supporting a track casing 309*a* with interpositioning of a wear ring. Inside ring 308 is received a bearing 310 which holds in position a shaft 311 supporting and passing through the roller 312 of track 309 which is held in position by two bearings 313 and 314 and a free wheel 315. At is other end, shaft 311 is held in position by two bearings 316*a*, 316*b*, themselves held in position inside the transmission casing 302. The latter receives the articulation by means of a ring not shown.

Transmission takes place from shaft 54 through a pinion or keyed pulley 317, a chain or notched belt 318, to a pinion or pulley 319 keyed on shaft 311 which drives the track properly speaking 320 via the roller 312.

The two track casings 309*a*, 309*b* hold the rollers 321*a* to 324 of the bearing race of track 320 in position as well as the tensioner roller 325 and the track supporting roller 326. All comprise a long clamping bolt 327 and a bearing tube 328. Two ball bearings could be mounted on each roller.

The flexible rubber covered track 320 receives at its periphery a set of shoes 329 for better adherence on snow (FIG. 7). When the caterpillar track 320 is in a position raised through orifice 300*a*, shoes 329 do not extend below the ski 300.

Shaft 544 rotates in a direction such that the track 320 tends to bear on the snow so as to give better adherence. For that it is assisted by four springs 330, 331, 332 and 333 fixed to the track casings 309*a* and 309*b* by one end and, by the other end, to bent lugs 334 screwed to ski 301 by screws 335.

The assembly 8-9-10 is held in position on ski 301 by a lug 336, on the motor 8 side (FIG. 8), which is held in position thereon by bolts not shown and on the ski 300 by screws 337. Two other lugs (FIG. 7) hold the bevel gear box 10 in position on the ski 338.

According to the invention, the track assembly 320 may be raised by a control system and lowered by a simple action of the tip of the ski stick on the lever.

At one end of shaft 54 is keyed a piece 339 which has a central stud or shaft 340. The latter receives a ring 341 held in position by pin 342 and provided with a "ferodo" serving as support on piece 339 Ring 341 is extended by a lever 343 to which is articulated a rod 334 whose opposite end is articulated to a link 345.

The latter is pierced with three holes, two for holding two right angle levers 346, 347, fixed both to ski 300 by screws 348 and to studs 349 carried by casing 309*a*. At its end link 345 receives the end of a spring 350 connected to the same base 334 as said spring 333.

When the lever 343 is actuated, the right angled levers 346, 347 bear on the studs 349 fast with casing 309*a* and the whole assembly rises, the top position being shown in FIGS. 7 and 8.

The track 320 may be locked at the front and at the rear by pawls 351, 352 which hold in position from underneath two lugs 353, 354 welded to casing 309*b*. The two pawls 351, 352 are held on the two lugs 353, 354 by springs not shown between the lug considered and a casing cover 355 held on the ski 300 by front and rear fasteners 356.

The two pawls 351 and 352 are fixed to a shaft 357 held in position by three bearings 358 (two are shown in FIG. 6) in the casing 355. Shaft 357 projects at 357*a* from casing 355 where it is bent inwards of the ski 300 so as to permit the track 320 to be readily released by a pressure on said shaft 357.

When track 320 is caused to rise through orifice 300*a* and has reached the top position, a contactor 359 (FIG. 6) controls the correct position and neutralizes the driving effect of lever 307.

Figure 9:
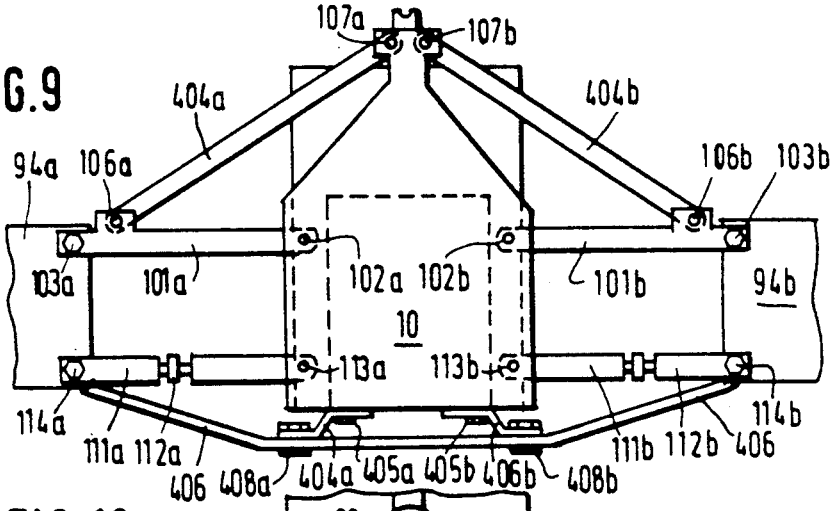
FIG. 9 shows partially the rear view of a roller skate, such as shown in FIG. 3, but showing the modifications for mounting the track.
Figure 10:
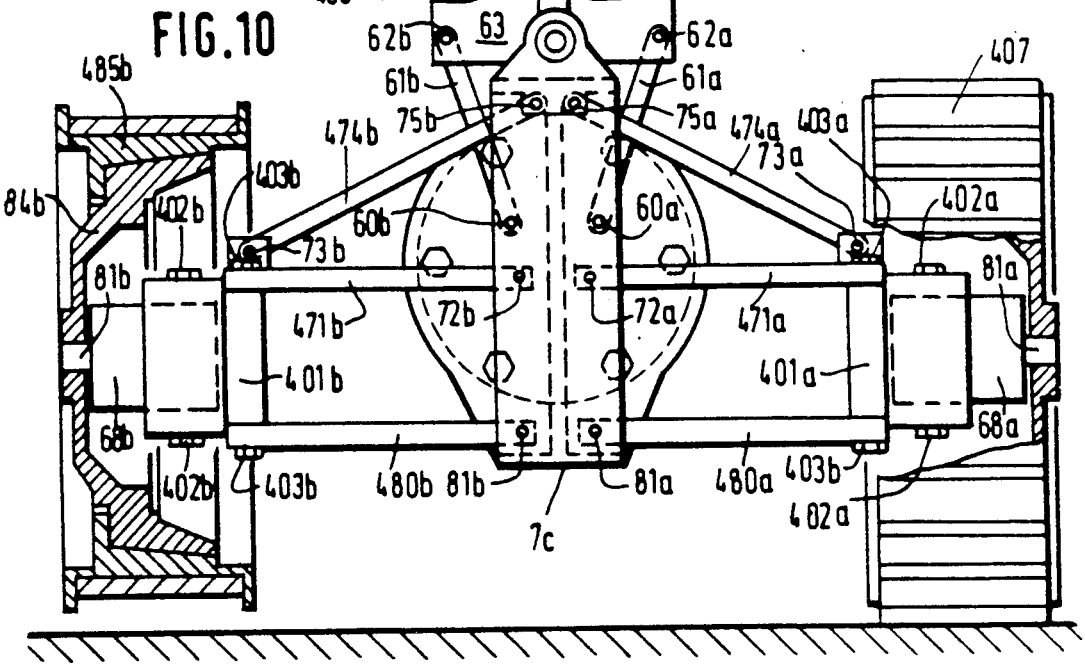
FIG. 10 shows, partially in elevation and partially in section, the front view of a roller skate, such as shown in FIG. 4, but showing the modifications for mounting a track.
Figure 11:
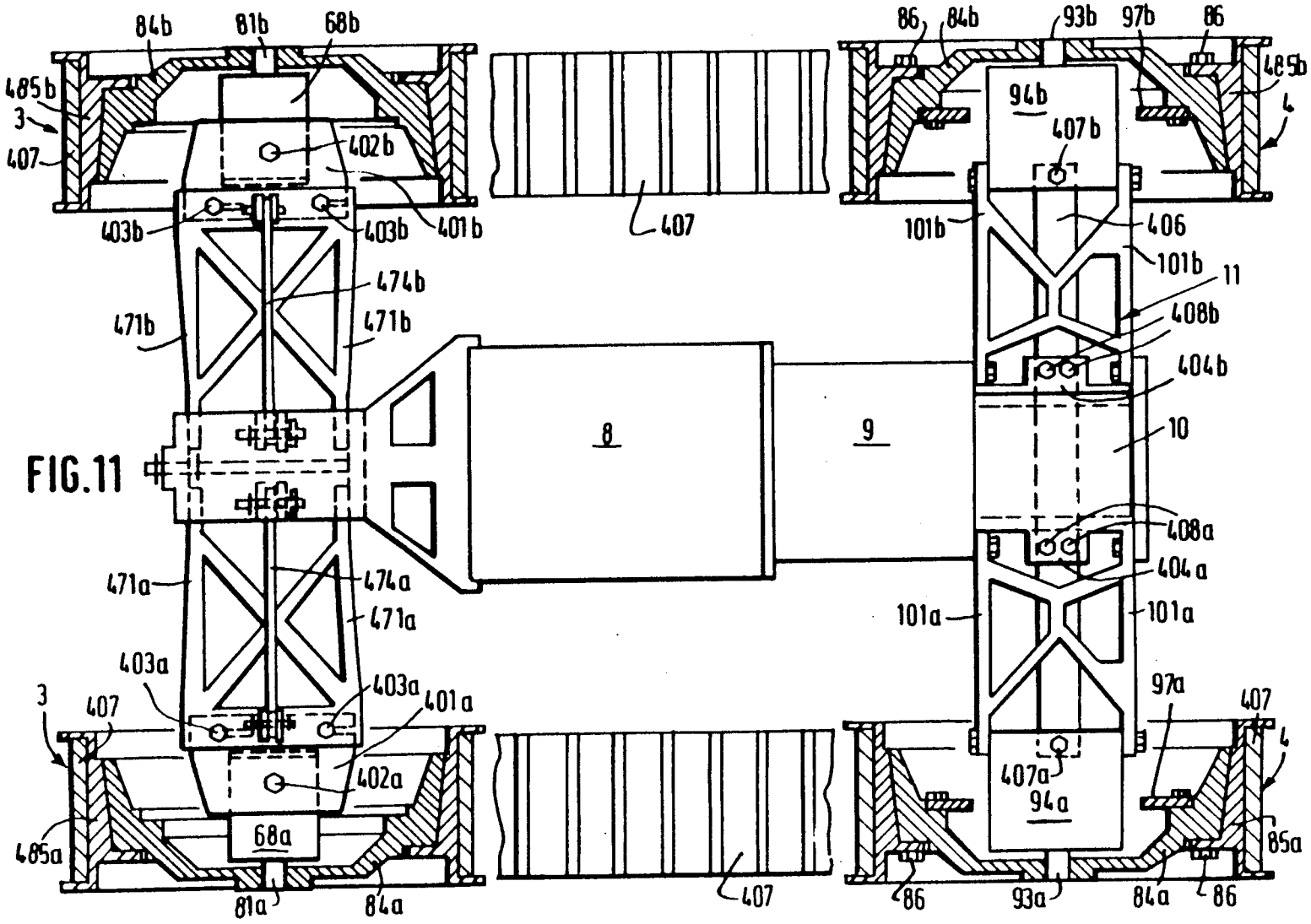
FIG. 11 shows a top view, similarly to FIG. 2, of a roller skate equipped with tracks.

FIGS. 9 to 11 are views similar to FIGS. respectively 3, 4 and 2, showing a variant which consists of a skate with double track. The elements of the skate of FIGS. 2 to 4 which are identical in these three last figures, have been designated by the same references and the similar elements by references greater than 300.

The front train (FIG. 10) is modified to comprise a wheelbase identical to that of the rear train by means of upper parallelograms 471*a*, 471*b* with a slide for tensioning the track. These parallelograms 471*a*, 471*b* are held in position by identical bolts 72*a*, 72*b* on the frame 7*c*, and similarly the lower parallelograms 480*a*, 480*b* which are held in position by bolts 81*a*, 81*b* on said frame 7*c*.

Pieces 401*a*, 401*b* join the lower and upper parallelograms to the hubs 68*a*, 68*b*, these pieces being each held on the hubs 68*a*, 68*b* by bolts respectively 402*a*, 402*b*. The upper and lower parallelograms are fixed to pieces 401*a*, 401*b* by bolts 403*a*, 403*b* which permit tensioning of the track.

The suspension jacks 74*a*, 74*b* (FIG. 4) are each replaced by a rigid link 474*a*, 474*b* held in position by shafts of the same type 73*a*, 73*b* on the wheel side and 75*a*, 75*b* on the frame 7*c* side. Thus, a rigid assembly is obtained. To prevent pivoting of the sole piece 63, the ball joints 60*a* and 60*b* are mounted in frame 7*c*, the two links 61*a*, 61*b* being thus rigidly locked.

The rear train (FIG. 9) is held rigid by the replacement of the damping jacks 104*a*, 104*b*; 105*a*, 105*b* by rigid rods 404*a*, 404*b* held in position by the same bolts 106*a*, 106*b*. The length of the lower parallelograms 111*a*, 111*b* will be adjusted by an adjustment means 112*a* , 112*b* so that it is identical to that of the upper parallelograms 101*a*, 101*b*; thus, the wheels will be perpendicular to the ground.

Under the casing 10 two supports 404*a*, 404*b* are fixed by bolts respectively 405*a*, 405*b*, a sole piece 406 being fixed at its ends to hubs 94*a*, 94*b* by bolts 407*a*, 407*b* (FIG. 11) and, in its central part, to the supports respectively 404*a*, 404*b* by bolts 408*a*, 408*b*.

On the four rims 84*a*, 84*b* are mounted four ribbed wheels 485*a*, 485*b* capable of receiving the two identical tracks 407 (FIG. 11).

Driving the skate with tracks is different from that of the roller skate, it is necessary to lift the feet and operate by sliding on the ground by bearing on the heels and lifting the toe of the foot.

Of course, the above embodiments are in no wise limitative and may give rise to any desirable modifications without departing from the spirit of the invention.

What is claimed is:

1. A self-propelled roller skate device comprising two units disposed in parallel, each unit being supported on front and rear pairs of wheels, each of said units including:

at least one propulsion system and a steering system mounted on a support and holding structure which includes a front frame and a rear frame;

power generation and storage means mounted independently of each of said units, and remote control means operatively coupled with and acting on each of said units and said power generation and storage means:

said steering system comprising:

a pivotable sole-piece, said sole-piece being pivotable in response to an action of a load carried about a pair of longitudinally extending shafts with one disposed behind the other and said sole-piece being pivotable against the force of a resilient return means;

a steering plate attached to a lower surface of said pivotable sole-piece;

a pair of spaced, vertically disposed links pivotably connected to said steering plate and depending therefrom;

a steering "T" having a vertical portion depending from a horizontal portion, the vertical portion being mounted for pivoting movement about a shaft attached to a rear wall of said front frame, a lower end of each vertically disposed link being pivotably connected to a respective end of the horizontal portion of said "T" thereby forming a deformable parallelogram;

a pair of ball joints fixed at a lower part of said steering "T", each of said ball joints being located on a respective lateral side of said steering "T", each said ball joint cooperating with one end of a respective one of a pair of horizontally disposed links, each said horizontally disposed link receiving at an opposite end a ball-joint rod which is fixed to a hub on a respective one of said pair of front wheels; and a pair of upper parallelograms and a pair of lower parallelograms, each one of said upper and lower parallelograms being mounted on a respective side of said front frame for pivotable movement about a longitudinal axis, each of said parallelograms having a pair of parallel branches and a triangular portion, the outermost tip of each triangular portion of said upper and lower parallelograms being connected to a respective top ball joint and lower ball joint carried by each of said hubs.

2. The device as claimed in claim 1, wherein said power generation and storage means includes a power generator, a regulation device with means to override said power generator and a power storage regulator.

3. The device as claimed in claim 1, wherein:

said propulsion system being associated with said rear frame and coupled with said rear wheels, and including a motor and a speed variator coupled thereto and with said rear wheels forming a propulsion system, and bevel gear means coupling said rear wheels with said variator for driving thereof imparting different forward driving speeds to said rear wheels; and a braking system associated with said wheels and including means acting on at least one of said rear wheels.

4. The device as claimed in claim 3, including means connected the front frame to the rear frame via said motor and said speed variator.

5. The device as claimed in claim 4, including jacks and wherein the speed variator is a gear box with pinions controlled by said jacks, said control system being connected to the rear wheels through the bevel gear means and a drive through a flexible coupling transmitting the rotational movement in a single direction.

6. The device as claimed in claim 4, wherein said power generation and storage means includes thermal energy means separate from each of said units, and said speed variator includes a gear box having pinions coupled with said rear wheels; jacks; and said bevel gear means includes a bevel gear box and Cardan joint means for coupling said bevel gear box through said jacks to said rear wheels for driving thereof in a single direction.

7. The device as claimed in claim 3, wherein said speed variator includes a gear box having pinions coupled with said rear wheels; and jacks, and said bevel gear means including a bevel gear box, and a Cardan joint for coupling said bevel gear box through said jacks to said rear wheels for driving thereof in a single direction.

8. The device as claimed in claim 3, wherein said braking system comprises disks mounted on at least the drive wheels and brake linings, the relative movement between said disks and said linings being controlled by said remote control means.

9. The device as claimed in claim 3, wherein said speed variator includes a gear box having pinions coupled with said rear wheels; and said bevel gear means includes a bevel gear box and Cardan joint means for coupling said bevel gear box through said jacks to said rear wheels for driving thereof in a single direction.

10. The self-propelled device as claimed in claim 1, wherein holes are formed in said vertically disposed links and in said steering "T" for regulating the length of the horizontally disposed links and for regulating the steering sensitivity and the size of the steering angle.

* * * * *